United States Patent [19]

Bertelsen

[11] 4,336,127

[45] Jun. 22, 1982

[54] STAGED BURNING OF RETORTED CARBON-CONTAINING SOLIDS

[75] Inventor: Corey A. Bertelsen, Oakland, Calif.

[73] Assignee: Chevron Research Company, San Francisco, Calif.

[21] Appl. No.: 267,137

[22] Filed: May 26, 1981

[51] Int. Cl.[3] ..... C10G 1/00; C10G 1/02

[52] U.S. Cl. ..... 208/11 R; 208/8 R; 201/31; 201/32

[58] Field of Search ..... 208/11 R, 8 R; 201/31, 201/32; 202/99, 215

[56] References Cited

U.S. PATENT DOCUMENTS

| | | | |
|---|---|---|---|
| 3,167,494 | 1/1965 | Crawford | 208/8 R |
| 3,454,383 | 7/1969 | Pirsh et al. | 201/31 X |
| 3,655,518 | 4/1972 | Schmalfeld et al. | 202/108 |
| 3,756,922 | 9/1973 | Schmalfeld et al. | 201/31 X |
| 3,852,216 | 12/1974 | Winomiya et al. | 201/31 X |
| 4,029,027 | 6/1977 | Smith | 110/28 |
| 4,165,717 | 8/1979 | Reh et al. | 122/4 |
| 4,199,432 | 4/1980 | Tamm et al. | 208/8 |
| 4,243,489 | 1/1981 | Green | 208/11 R X |
| 4,293,401 | 10/1981 | Sieg et al. | 208/11 R |

*Primary Examiner*—Delbert E. Gantz
*Assistant Examiner*—Glenn A. Caldarola
*Attorney, Agent, or Firm*—D. A. Newell; S. R. LaPaglia; J. W. Ambrosius

[57] ABSTRACT

Residual carbon in pyrolyzed solids burned by combusting a fine fraction separating in a first dilute phase combustion zone and mixing the fine fraction and the bulk of the pyrolyzed solids in a second dilute phase combustion zone.

8 Claims, 3 Drawing Figures

STAGED BURNING OF RETORTED CARBON-CONTAINING SOLIDS

BACKGROUND OF THE INVENTION

Certain naturally occurring materials contain a carbonaceous component which, upon heating, will release a hydrocarbon product which is useful as a feedstock in petroleum processing. These "carbon-containing solids," such as oil shale and tar sands, including diatomite, may be pyrolyzed in reactor vessels having various designs. Following the pyrolysis of the carbon-containing solid to extract the volatile components, a "pyrolyzed solid" remains which contains a carbonaceous residue which may be burned to yield heat energy. The heat recovered from this carbonaceous residue may be used to supply heat for the pyrolysis of fresh carbon-containing solids during the process.

The inorganic residue that remains after the combustion of the carbonaceous residue is called "ash," or in the case of oil shale, "burned shale." This material is recycled in some retorting processes as "heat carrier material," i.e., the hot burned shale from the combustion is mixed with fresh oil shale and the heat provided is used for pyrolyzing the fresh shale. U.S. Pat. Nos. 4,199,432 and 4,183,800 describe processes in which the oil shale or other carbon-containing solid is pyrolyzed in a downward moving bed containing a mixture of recycled hot burned shale (used as heat carrier material) and particulate fresh oil shale. A countercurrent flow of gas passes upward through the bed removing the product vapors and entraining the finer particulate fractions of the oil shale. The fine particles and product vapors are drawn off the top of the reactor vessel, and the fine shale particles are removed from the gas stream by a separation device, such as a cyclone. Processes such as this present some problems in designing an efficient combustor for burning the pyrolyzed oil shale which is recycled as the heat carrier material.

During combustion of the carbonaceous residue in the pyrolyzed oil shale to produce heat, the physical integrity of the shale particles is changed and a substantial amount of fine grained burned shale is produced which is not suitable for use as recycled heat carrier particles. Therefore, it is usually necessary to separate this fine material prior to recycling the coarser grained particles.

In process schemes using a liftpipe combustor to burn the carbonaceous residue in the pyrolyzed oil shale, sufficient residence time is required to complete combustion and to assure a thermal equilibrium between the hot burning particles and the cooler recycle particles. Typically, a minimum residence time of 2 to 3 seconds in the combustion zone is required. If the fine shale and coarse shale particles are combusted in a liftpipe, the pipe must be of sufficient length to provide adequate residence time for all particles.

The present invention is advantageous for efficiently burning particulate pyrolyzed oil shale or other particulate carbon-containing solids where the fine grained material and the coarser grained material are separated prior to combustion and the burned shale serves as heat transfer material in the process.

SUMMARY OF THE INVENTION

In its broadest aspect, this invention concerns a process for burning pyrolyzed solids containing a carbonaceous residue to provide heat for the pyrolysis of a particulate carbon-containing solid, wherein said pyrolyzed solids contain both a fine fraction and a coarse fraction and at least part of said fine fraction is contained in a separate feedstream from the coarse fraction of the pyrolyzed solids, said process comprising:

(a) burning at least part of the carbonaceous residue in the fine fraction contained in said separate feedstream in a dilute phase preburner by entraining the fine fraction in a first entraining gas stream containing oxygen and having a velocity greater than the terminal velocity of the particles in the fine fraction;

(b) mixing the entrained, partially burned fine fraction from the preburner with the remainder of the pyrolyzed solids in a second entraining gas stream having a velocity greater than the terminal velocity of the coarse and fine fractions; and (c) burning the unburned carbonaceous residue in the entrained fine and coarse fractions in a second dilute phase combustion zone through which the second entraining gas and entrained solids are directed, said second dilute phase combustion zone containing sufficient oxygen to burn all of the unburned carbonaceous residue in the fine and coarse fractions.

The process that is the subject of this invention is particularly advantageous when the carbon-containing solid is oil shale and the ash (or burned shale in the case of oil shale) is used as heat carrier material. In such a process scheme, means are usually provided for separating the fine ash leaving the second dilute phase combustion zone from the coarse ash. This is because ash particles smaller than about 100 mesh (Tyler Standard) are generally not suitable for recycling as heat carrier material. Various means for such a separation are known to those skilled in the art and include a solids disengaging zone, cyclones, sifting devices, etc. It should be understood that the terms "fine" and "coarse," when applied to both pyrolyzed solids and ash, are relative terms and the precise size of particle may vary in different embodiments of the invention or with the retorting process employed. However, for most purposes, a cut size of about 100 mesh represents a reasonable division of particle size between coarse and fine.

As used herein, the phrase "terminal velocity" refers to the maximum velocity attained by a particle falling in a very long column of stagnant air. A particle will become entrained in a flow of gas when the velocity of the gas exceeds the terminal velocity of the particle. Thus, an entraining gas is a gas having a velocity in excess of the terminal velocity of a given size of particle.

DETAILED DESCRIPTION OF THE INVENTION

Figure 1:
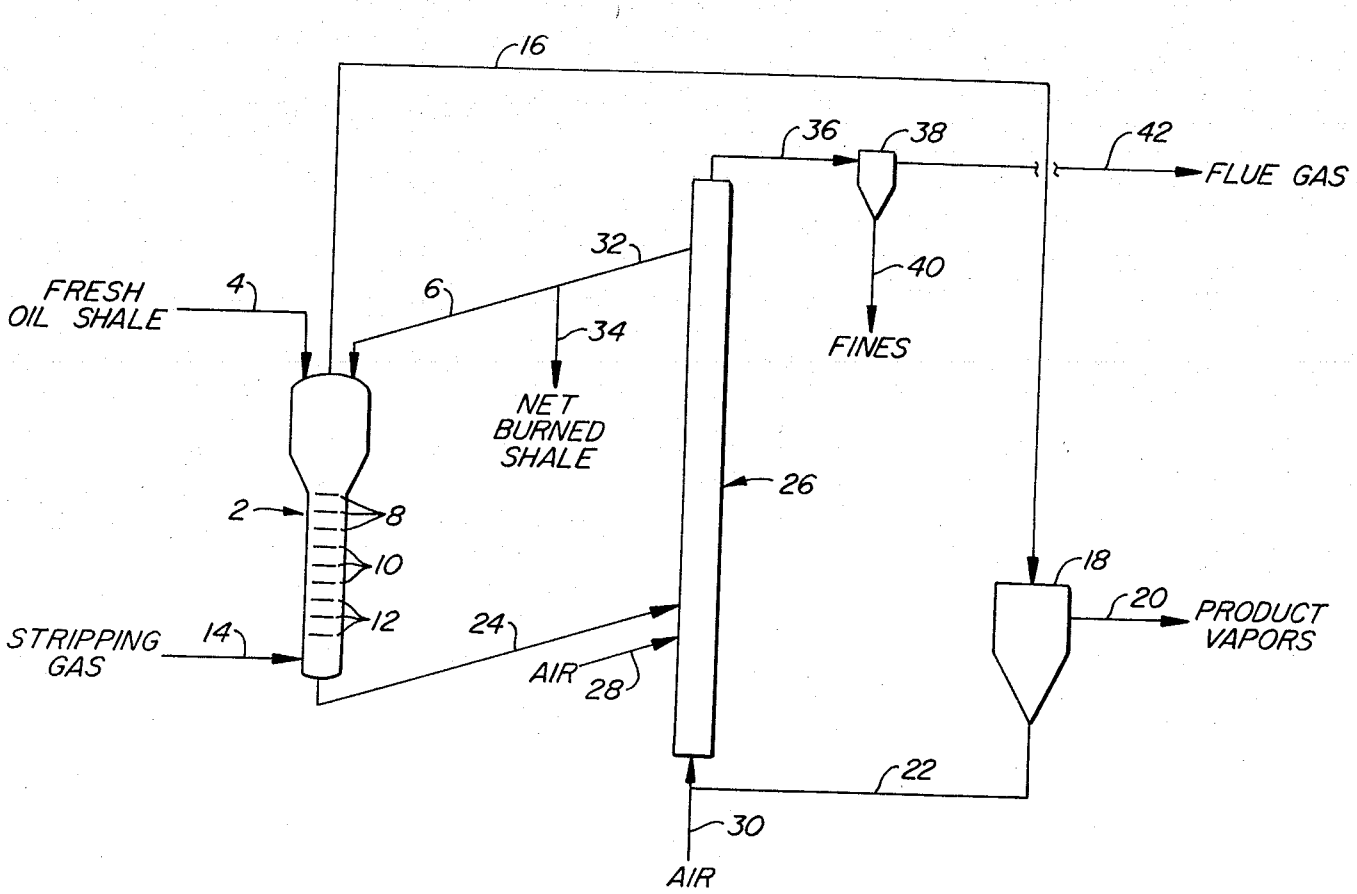
FIG. 1 is a schematic representation of an oil shale retorting process of the type in which the present invention may be used most advantageously.

Referring to FIG. 1, fresh crushed oil shale enters retort 2 via conduit 4 where it is mixed with the hot heat carrier material (burned shale) entering the retort through conduit 6. The mixture of hot burned shale and fresh shale moves downward in the retort 2 through a series of dispersing elements 8, 10 and 12 which prevent substantial vertical backmixing of the solids. A substantially oxygen free stripping gas enters retort 2 through gas inlet 14 creating a countercurrent gas flow through the retort in opposition to the downward moving bed of shale. Gas from the gas inlet 14, product vapors, and pneumatically entrained fine particles of shale move upward and leave the retort via conduit 16. The gas and product vapors are separated from the entrained fines in cyclone 18; the gaseous material exits by conduit 20 and the fines are carried away by conduit 22.

The coarse material containing particles of both burned oil shale and pyrolyzed oil shale leaves the bottom of retort 2 via solids conduit 24 and is conveyed to the combustor 26. Air entering the combustor via air conduit 28 is mixed with the coarse particles of shale, and the residual carbonaceous material present in the pyrolyzed material is ignited. In this particular process scheme, the fine particulate oil shale material separated by cyclone 18 enters the combustor as a separate feedstream from the coarse particulate material from the retort. The advantages of this scheme will be discussed in detail later. The fine material carried by conduit 22 is pneumatically entrained by air from conduit 30 and enters the combustor at the bottom. Following combustion of the carbonaceous residue, the coarse particles of burned shale and fine particles of burned shale are separated in the top part of the combustor. The coarse particles of burned shale leave the combustor via common conduit 32. Hot burned shale serving as heat carrier material is recycled to the retort via conduit 6 while excess burned shale is drawn off through outlet 34. Flue gases and entrained fines leave the combustor via conduit 36 and are carried to cyclone 38. Fines are disposed of through conduit 40. Flue gases are carried off via conduit 42 for venting or recycling as stripping gas.

Figure 2:
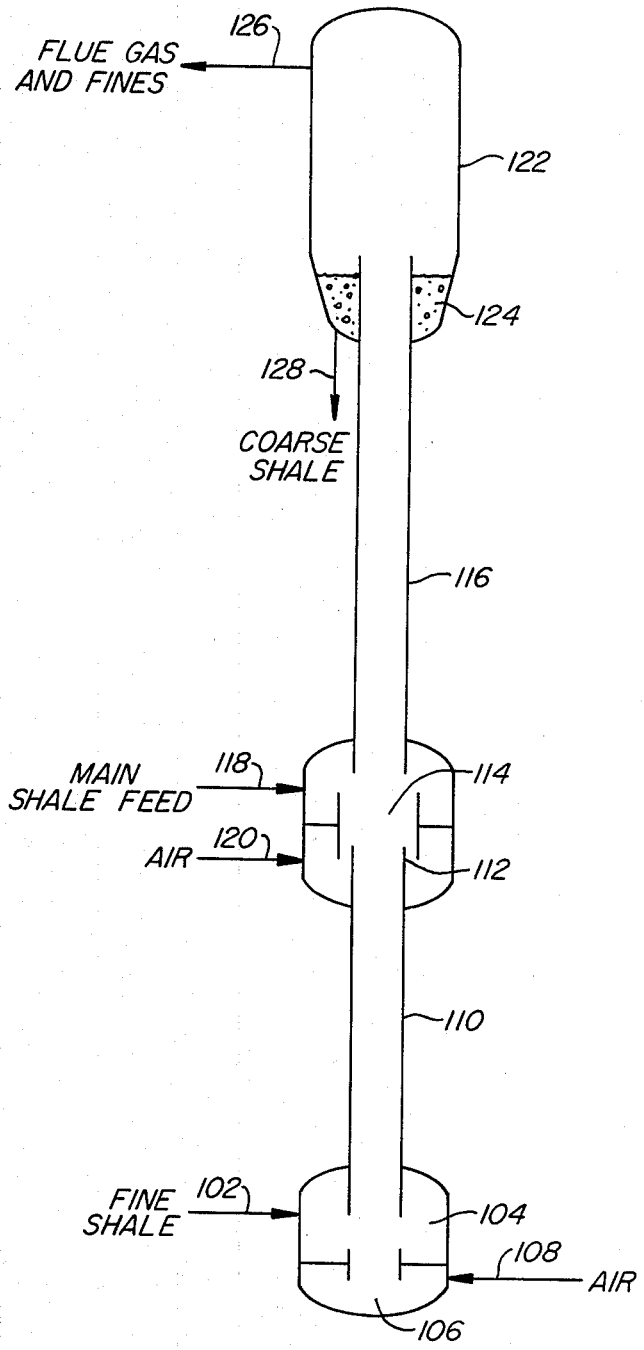
FIG. 2 illustrates a cross-sectional view of one design for a combustor which may be used in the process.

Turning to FIG. 2, a combustion device suitable for use in the retorting process described above is illustrated. Fine particles of shale separated from the product vapors and stripping gas enter the engaging chamber 104 at the bottom of the combustor via conduit 102. Air enters chamber 106 by way of air line 108. The fine particles of shale are entrained by the air stream and carried upward through the fine shale preburner 110 where they are ignited and partially burned. The burning fines exit the open upper end 112 of the fine shale preburner 110 and enter the main liftpipe engaging area 114 for the main combustion liftpipe 116.

Pyrolyzed shale from the bottom of the retort enters the main liftpipe engaging area 114 via conduit 118. This feed may contain some fine particles but will consist mostly of coarser grained shale particles of a large enough size to not be entrained by the stripping gas passing through the retort. Shale entering via conduit 118 along with fine shale from the preburner 110 are entrained in additional air entering through air conduit 120. Both coarse and fine particles are carried upward by the gas stream and burned in the main combustion liftpipe 116. The burned particles of oil shale enter the enlarged disengaging chamber 122 of the combustor which serves as a coarse solids disengaging area. The coarse particles of burned shale settle out in collection zone 124 while the burned fines and flue gases leave the combustor via outlet 126. Coarse particles of burned shale for recycling to the retort or for disposal are removed via outlet 128.

Figure 3:
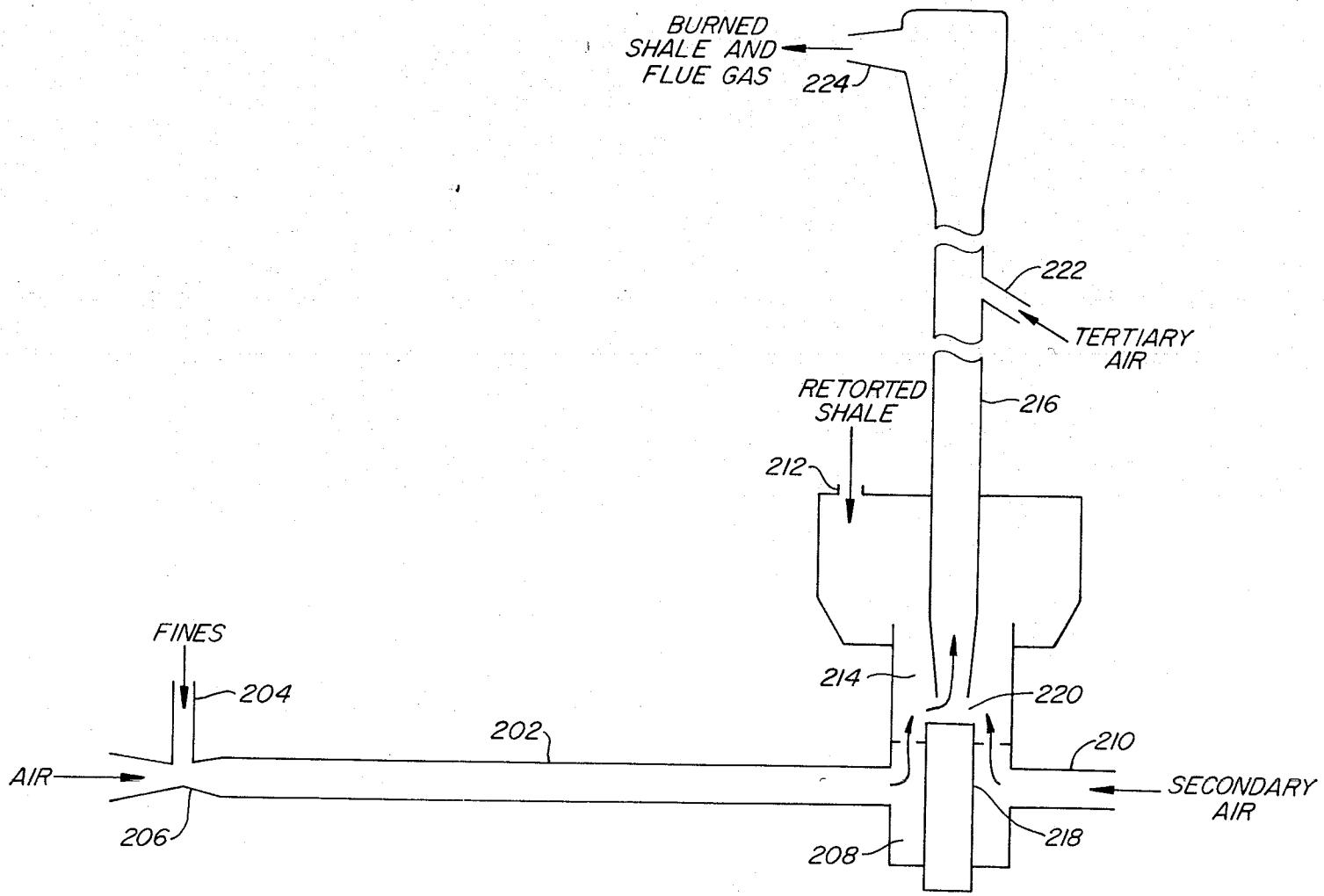
FIG. 3 illustrates a cross-sectional view of an alternate design for a combustor which may be used in the process.

An alternate embodiment for a combustor which may be used in carrying out this process is shown in FIG. 3. In this design the fine shale enters the vertical fine preburner 202 via conduit 204. Air enters the preburner and entrains the fines by way of a venturi throat 206. The burning fines enter plenum chamber 208 where they are mixed with secondary air entering via conduit 210. The bulk of the retorted oil shale enters the combustor through conduit 212 and is mixed in the engager 214 with the fines entering from the plenum chamber. The velocity of the primary and secondary air is sufficient to entrain both the coarse and fine particles which are carried up the main liftpipe combustor 216 where the coarse material is burned. An adjustable seat 218 controls the size of opening 220 between the engager and the main liftpipe combustor 216. Tertiary air may be introduced as needed via conduit 222 to maintain sufficient velocity to prevent choking of the liftpipe, i.e., collapse of the solids due to insufficient velocity to maintain entrainment, or to introduce additional oxygen for combustion. The burned shale and flue gas leave the combustor via outlet 224 and pass to a solids disengaging zone (not shown).

A particularly preferred way of operating the process which is the subject of this invention is by inclusion of a preburner for the coarse shale to partially burn the carbonaceous residue therein prior to mixing with the fine shale in the second dilute phase combustion zone. This makes it possible to decrease the length of the main combustion liftpipe. In one preferred mode of operation, the corase shale is partially burned in a fluidized bed prior to entering the second dilute phase combustion zone.

In carrying out the process that is part of this invention, the fine particles of pyrolyzed oil shale are preferably burned in the fine shale preburner with a substoichiometric amount of oxygen, i.e., insufficient oxygen to allow complete combustion of the char. An air to fuel ratio in the range of from about 0.2 to about 0.9 would be suitable for operation. This is to prevent excessive carbonate decomposition. Usually, the temperature in the fine shale preburner is kept below about 1500° F.

Although the process of this invention is most advantageously used in an oil retorting process using recycled burned shale as the heat transfer material, the invention should not be limited to that retorting method. One skilled in the art can easily devise schemes by which other types of heat transfer material such as, for example, ceramic compositions, sand, alumina, iron, steel, or the like, are employed. In such an instance, the heat transfer material may be simply mixed with the coarse shale feedstream to the combustor. Even in processes using burned shale as the principal heat transfer material, it is often necessary to add supplemental heat transfer material to the system. Likewise, it is possible to devise other embodiments of the invention which could utilize the hot flue gas in retorting the raw oil shale or even use the combustor to heat water to produce steam.

In addition, if the carbonaceous residue in the pyrolyzed solids is insufficient to provide the necessary heat for maintaining the temperature in the reactor vessel at pyrolyzing levels, a supplement fuel, such as granular coal or oil, may be added to the solids entering the combustor. Such a mode of operation may be necessary when the carbon-containing solid is of a low grade or where large amounts of supplemental heat carrier material are employed, thus lowering the percent of carbonaceous residue present in the feed.

I claim:

1. A process for burning pyrolyzed solids containing a carbonaceous residue to provide heat for the pyrolysis of a particulate carbon-containing solid, wherein said pyrolyzed solids contain both a fine fraction and a coarse fraction and at least part of said fine fraction is contained in a separate feedstream from the coarse fraction of the pyrolyzed solids, said process comprising:

(a) burning at least part of the carbonaceous residue in the fine fraction contained in said separate feedstreem in a dilute phase preburner by entraining the fine fraction in a first entraining gas stream containing oxygen and having a velocity greater than the terminal velocity of the particles in the fine fraction;

(b) mixing the entrained, partially burned fine fraction from the preburner with the remainder of the pyrolyzed solids in a second entraining gas stream having a velocity greater than the terminal velocity of the coarse and fine fractions; and (c) burning the unburned carbonaceous residue in the fine and coarse fractions in a second dilute phase combustion zone through which the second entraining gas and entrained solids are directed, said second dilute phase combustion zone containing sufficient oxygen to burn all of the unburned carbonaceous residue in the fine and coarse fractions.

2. The process of claim 1 wherein the fine fraction of pyrolyzed solids is partially burned in the preburner with a substoichiometric amount of oxygen.

3. The process of claim 1 including the additional step of separating a fine fraction of ash from a coarse fraction of ash, said ash being formed by the combustion of the pyrolyzed carbon-containing solids.

4. The process of claim 3 wherein the coarse fraction of ash is recycled as heat carrier material.

5. The process of claim 1 wherein the carbon-containing solid is oil shale.

6. The process of claim 5 wherein the temperature of the fine fraction in the preburner does not exceed 1500° F.

7. The process of claim 5 wherein the air to fuel ratio in the preburner is in the range of from about 0.2 to about 0.9.

8. The process of claim 1 wherein a supplemental fuel is added to the pyrolyzed solids before entry into the combustion zone.

* * * * *